United States Patent [19]

Schneider et al.

[11] 4,352,627

[45] Oct. 5, 1982

[54] LOADING DEVICE FOR A PRESS

[75] Inventors: Franz Schneider, Göppingen; Rolf Rühl, Rechberghausen, both of Fed. Rep. of Germany

[73] Assignee: L. Schuler GmbH, Göppingen, Fed. Rep. of Germany

[21] Appl. No.: 981

[22] Filed: Jan. 4, 1979

[30] Foreign Application Priority Data

Jan. 5, 1978 [DE] Fed. Rep. of Germany ..... 2800381

[51] Int. Cl.[3] ..... B30B 15/30

[52] U.S. Cl. ..... 414/752; 414/121; 414/627

[58] Field of Search ..... 414/120–122, 414/61 B, 627, 749, 751, 752, 416, 591; 318/567; 271/67; 100/207

[56] References Cited

U.S. PATENT DOCUMENTS

| | | | |
|---|---|---|---|
| 2,822,094 | 2/1958 | Greer | 414/749 X |
| 2,881,929 | 4/1959 | Giffen | 414/122 X |
| 2,942,736 | 6/1960 | Landsiedel | 414/749 X |
| 3,288,088 | 11/1966 | Leedy | 414/416 X |
| 3,404,789 | 10/1968 | Georgeff et al. | 414/14 |
| 3,456,814 | 7/1969 | Bautz | 414/751 X |
| 3,575,301 | 1/1971 | Panissidi | 414/618 |
| 3,707,908 | 1/1973 | Merk | 414/749 X |
| 3,774,778 | 11/1973 | Flaig | 414/751 X |
| 3,834,555 | 9/1974 | Bennington | 414/627 |
| 3,884,363 | 5/1975 | Ajlouny | 414/751 X |
| 3,910,423 | 10/1975 | Killian | 414/591 |
| 3,951,271 | 4/1976 | Mette | 414/591 |
| 4,015,721 | 4/1977 | Scheler | 414/591 X |
| 4,067,458 | 1/1978 | Schneider et al. | 414/118 |
| 4,124,242 | 11/1978 | Canner | 414/591 X |
| 4,132,318 | 1/1979 | Wang et al. | 414/618 X |

*Primary Examiner*—John J. Love
*Assistant Examiner*—Terrance L. Siemens
*Attorney, Agent, or Firm*—Antonelli, Terry & Wands

[57] ABSTRACT

In loading a press, it is desirable to provide a loading device which can be driven independently of the main driving means of the press and which causes a minimum of surface damage to the blanks being loaded into the press. To achieve this, gripper elements are provided which are coupled to adjustable drive systems controlled by a numerical control unit. The gripper elements are capable of motion in at least two planes perpendicular to each other to remove devices from the stack and carry them along a preselected path into a tool chamber of the press.

13 Claims, 2 Drawing Figures

LOADING DEVICE FOR A PRESS

FIELD OF THE INVENTION

The invention relates generally to a loading device for a press and, more particularly to a loading device having numerically controlled drive means to move gripper elements during loading.

DESCRIPTION OF THE PRIOR ART

German Unexamined Laid-Open Application DOS No. 1,481,147, which corresponds to U.S. Pat. No. 3,404,789, shows one prior art example of a load device for a press wherein the press is supplied with blanks on pallets via a conveyor belt. Vacuum suction devices are provided on a vertically movable bridge at the unstacking station to separate the blanks and transport them to a magnetic roller train by a lifting action. From the magnetic roller train the blanks arrive, via a double blank checking means, and a lubrication station, at a first depot table, which at the same time serves to separate double blanks by an outward pivoting motion. The blank lying on this first depot table is transported from this table to a second depot table in front of the tool chamber of a press with the aid of a gripper element equipped with vacuum suction devices. In this connection, in a normal case of operation, a blank lying on the second depot table is carried into the tool chamber of the press and deposited in position by means of a second gripper element which is mechanically connected to the first gripper element. In this loading device, the gripper elements are driven by the main driving means of the press via suitable gear connections, while the vacuum suction devices have a separate driving means, similar to that of the conveyor belt, in the area of the magnetic roller train. This loading device suffers the disadvantage that it can only be used on a press which employs gripper elements driven by the main driving means of the press. Further, the loading device has the disadvantage that expensive adjustments and adaptation measures are necessary when the press is changed over for another workpiece.

German Unexamined Laid-Open Application DOS No. 2,534,819, which corresponds to U.S. Pat. No. 4,067,458, shows a loading device free of the above disadvantages. In this context, blanks are unstacked from two lift carts by means of, for example, vacuum suction devices, and are then transported suspended by magnetic conveyor belts via a checking means for double blanks and an ejector device in the area of a pawl advancing apparatus. The blank is then slid into the tool chamber of the press by the pawl advancing apparatus. Although this arrangement does overcome the above-discussed problems, it is difficult to utilize for blanks from which outer covering sections for the body of a motor vehicle are manufactured, because such blanks could be easily damaged with this type of transport.

SUMMARY OF THE INVENTION

Therefore, it is an object of the invention to provide a loading device which is driven independently of a main driving means of the press, and which carries the blanks with minimum surface damage, to deposit them in position in the tool chamber of a press.

To accomplish this and other objects, a loading device for loading blanks from a stack into a tool chamber is provided with gripper elements coupled to a plurality of adjustable drive means which are controlled by a numerical control unit. These gripper elements are movable by said adjustable drive means in at least two planes perpendicular to each other so that they can remove devices from the stack and carry them along a preselected path into the tool chamber.

The advantages of a loading device according to the present invention include its simple construction and its almost universal applicability in the automation of presses or press trains. Another advantage is the gentle treatment of the surface of the blank during transport. The simple and space-saving structure results from the omission of unnecessary conveyor belts and/or lift carts. Furthermore, an elaborate pawl advancing means and/or several gripper elements can be dispensed with.

BRIEF DESCRIPTION OF THE DRAWINGS

Other objects and advantages of the present invention may be more clearly understood by reference to the following detailed description and drawings, wherein.

DETAILED DESCRIPTION

Figure 1:
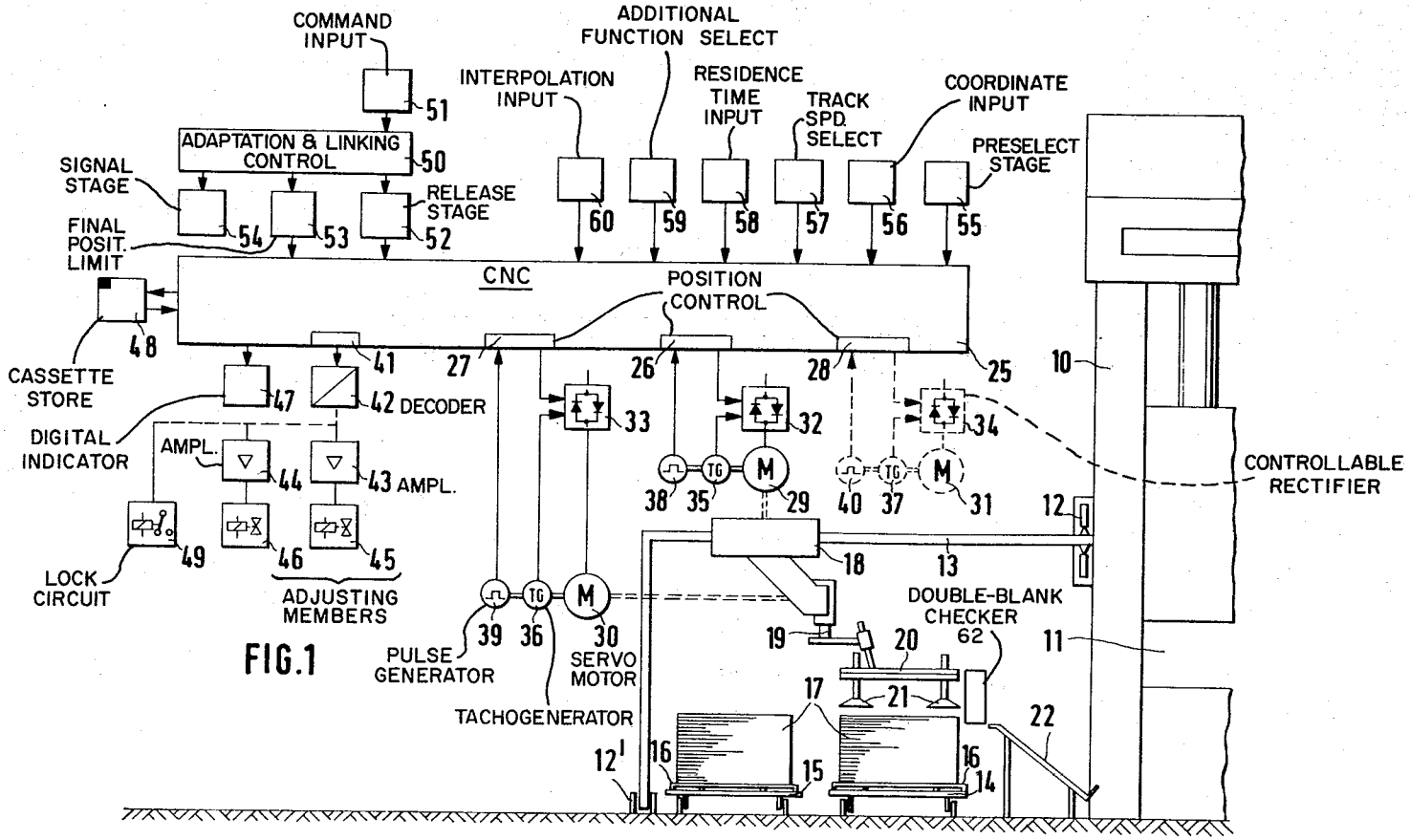
FIG. 1 is a side elevational view of a loading device with continuous-path numerical control for a press according to the present invention.

Referring now to FIG. 1, a press 10 is shown having a working chamber (working area) 11, and guide tracks 12 which extend on the front face of the press in a horizontal direction. A support frame 13 is movably mounted in these guide tracks 12. The support frame 13 spans two exchangeable pushcarts 14, 15 in an L-shape (these exchangeable pushcarts are described in more detail in FIG. 2). The frame 13 is also supported by a guide track 12' which is provided at a distance away from the press 10.

In the area under the frame 13, pallets 16 are placed on the exchangeable pushcarts 14, 15. Stacks 17 of blanks to be unloaded are then located on these pallets 16. A conveying carrier 18 is movably arranged on a guide track (not shown) of the support frame 13 to be movable over the pallets 16 and toward the working chamber 11. A support 20 is position-adjustably arranged on the conveying carrier 18 by way of a guide element 19 which transmits the lifting and lowering motions. On the support 20 itself, gripper elements in the form of vacuum suction devices 21, which act vertically, are resiliently mounted. A double blank depot 22 is provided between the press 10 and the first pushcart 14.

The above-described loading device is controlled by means of a continuous-path numerical control 25 (hereinafter referred to as CNC control 25) which is constructed in a conventional manner with a process computer and storage units. The Sinumerik Mate M manufactured by Siemens specifically for drilling and milling machines is one example of a commercially available unit which can be used for the CNC control 25. On the output side of the CNC control 25 two (three) position controllers 26, 27,(28) are integrated, with each being respectively associated with one adjusting drive means 29, 30,(31). The adjusting drive means 29 causes the horizontal motion of the entire conveying carrier 18, while the adjusting drive means 30 brings about the vertical motion of the vacuum suction devices 21 placed on the conveying carrier 18. The adjusting drive means 31 can be provided for influencing the position of the support frame 13 if desired.

The position control circuits of the adjusting drive means 29, 30, (31) are all constructed in the same manner, and each has one controllable rectifier 32, 33, (34), respectively, which obtains an ideal speed value from the attached position controllers 26, 27, (28) and an actual value of speed from one tachogenerator 35, 36, (37) connected to the respective adjusting drive means 29, 30, (31). Further, incremental pulse generators 38, 39, (40) are associated with the adjusting drive means 29, 30, (31) to report the respective actual position value to the position controller 26, 27, (28). In this connection, the theoretical position value is determined by the CNC control 25 and processed with the actual position value. A resulting control signal based on this comparison arrives at the controllable rectifiers 32, 33, (34).

In addition to the position controllers 26, 27, (28), the CNC control 25 has other signal outputs 41 which are connected to adjusting members 45, 46 by way of a decoder 42 and amplifiers 43, 44. The adjusting members 45, 46 could be valves, for example, which would cause the switching on and off of the vacuum suction devices 21. Typical characteristic values of the loading device can be shown on a digital indicator 47. A cassette storage input 48 is also connected to the CNC control 25 so that programs can be readily changed by exchanging the cassette. By means of a locking circuit 49, controlled by the signal outputs 41 via the decoder 42, the actual press control, not shown, is locked in such a way that the press 10 is securely prevented from starting for as long as the vacuum suction devices 21 are located in the direct area of the press, i.e., in the tool chamber 11.

On the one hand, the input side of the CNC control 25 has an adaptation and linking control 50, the essential object of which consists of linking the press control to the CNC control 25. The Logitrol control system described in General Electric brochure GEA-9478A is one example of a unit which can be used for this adaption and linking control 50. For this purpose the adaptation control 50 is connected to a command input 51 which is supplied with signals typical in press operation, e.g. position signals, tool loaded, unloaded. Connected after the adaptation control 50 but before the CNC control 25 are a release stage 52, which starts the adjusting drive means 29, 30, (31), and a final position limiting stage 53, which keeps the conveying carrier 18 from moving beyond the most extreme final positions and thus prevents damage or impairments. At the same time, the adaptation control 50 controls a signaling stage 54 which indicates the course of the function of the loading device within a function flow diagram with the aid of indicating devices such as light-emitting diodes.

Further, the CNC control 25 also has directly connected input stages comprising: a preselection stage 55 for the type of operation; a coordinate input stage 56 for the points along which the adjusting drive means 29, 30, (31) are to be directed; a track speed selection stage 57; a residence time input stage 58; an additional function selection stage 59; and an interpolation input stage 60. The input of the motion cycle of the loading device can be performed manually by way of the latter input stages 55 through 60.

The preselection stage 55 for the type of operation preselects, for instance, reinitiating operation, continuous operation, etc. while the points, along which motion is conducted, are determined via the coordinate input stage 56. With the aid of the interpolation input stage 60, it is determined in which manner the motion along the preselected points is conducted. This may be either in a direct, linear fashion, i.e., along the shortest path, in arcs or in the manner of track control.

Figure 2:
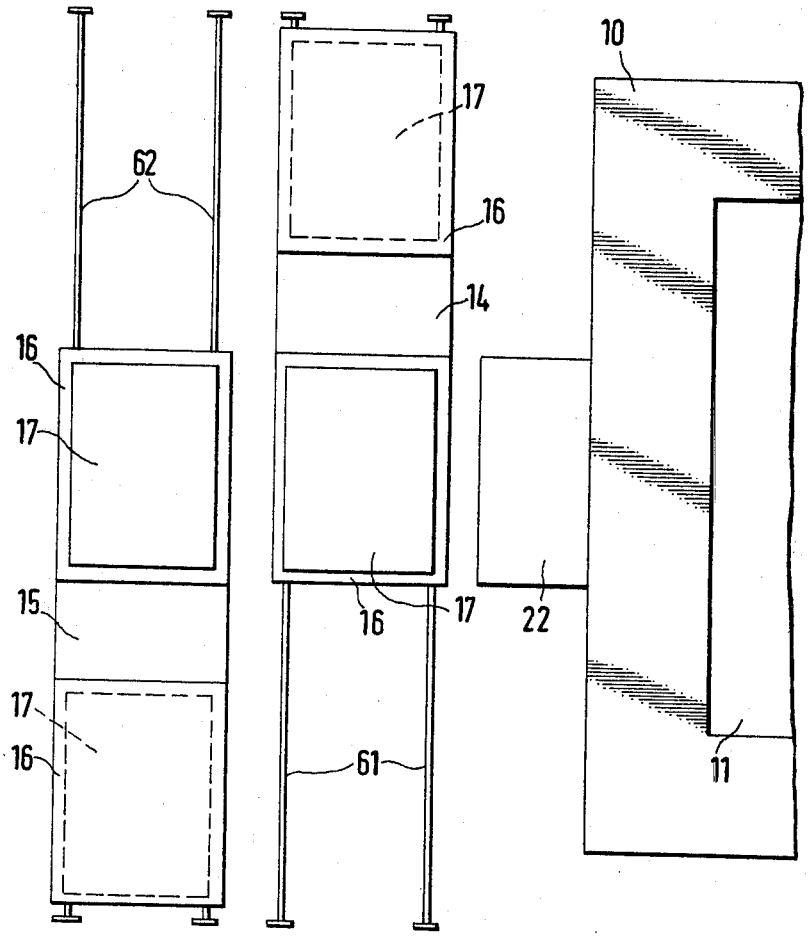
FIG. 2 is a top view of a portion of FIG. 1.

In the plan view shown in FIG. 2, the exchangeable pushcarts 14, 15 are shown in more detail. The exchangeable pushcarts 14, 15 are movable on tracks 61, 62 from one final position into the other, wherein in each end position there is always one pallet 16 beneath the conveying carrier 18 with a stack 17 of blanks ready to be unloaded, while at the free end of the respective exchangeable pushcart 14, 15 an empty pallet 16 can be exchanged for one provided with a stack 17 of blanks. In this connection, uninterrupted operation is possible even when only one exchangeable pushcart 14, 15 is used. The double blanks occurring from time to time are deposited or ejected in the double blank depot 22 which, in contrast to the example shown, can also be provided behind or next to the stack of blanks to be unloaded. The check for double blanks takes place in this connection using a double blank checker 62 during the lifting motion of the support 20 after the release of one blank from the stack 17 of blanks by means of the vacuum suction devices 21. This double blank checker can be of the type shown in U.S. Pat. No. 3,404,789 or U.S. Pat. No. 4,067,458 mentioned earlier.

In the following, the function of the above-described loading device with a CNC control 25 is described.

The initial situation represented in FIG. 1 shows filled stacks 17 of blanks on the two exchangeable pushcarts 14, 15 which are in the position depicted in FIG. 2. The adjusting drive means 29, 30 move the conveying carrier 18 along a preselected path curve according to the program in such a manner that by way of a lifting action of the vacuum suction devices 21, a blank is lifted from the stack 17 of blanks, conveyed into the tool chamber 11 of the press 10, and deposited in position on a shaping tool (not shown). If, for example, a double blank is obtained during the lifting action, then the conveying carrier 18 conveys this double blank only to the double blank depot 22 in order to immediately separate a new blank from the stack 17 of blanks and supply it to the tool chamber 11 of the press 10. As the stack 17 of blanks reduces in size, there is a stepwise follow-up control of the lifting action by way of the adjusting drive means 30.

As soon as the one stack 17 of blanks on the exchangeable pushcart 14 has been emptied, the conveying carrier 18 begins to remove the blanks from the stack 17 of blanks on the exchangeable pushcart 15 with the aid of the vacuum suction devices 21. Meanwhile the exchangeable pushcart 14 is moved from the final position shown in FIG. 2 into the opposite final position, whereby the stack 17 of blanks already held ready on the pallet 16 at the free end of the exchangeable pushcart 14 arrives below the conveying carrier 18, while the empty pallet 16 on the now free end of the exchangeable pushcart 14 can be exchanged for a pallet provided with a stack 17 of blanks. As soon as the stack 17 of blanks on the exchangeable pushcart 15 has been emptied, the conveying carrier 18 again conveys the blanks from the exchangeable pushcart 14 to the press 10, while the already described exchange of the pallets 16 takes place on the exchangeable pushcart 15.

Uninterrupted operation is also possible with only one exchangeable pushcart 14, 15, provided the exchange can take place rapidly. This is relatively easy to achieve with an appropriate program.

An especially advantageous type of individual separation can be realized by providing at the beginning of the separation process a low-frequency vibration superimposed with fading on the vacuum suction devices 21 or the conveying carrier 18. This vibration affects the conveying carrier 18 essentially in a horizontal direction by way of the adjusting drive means 30 controllable in accordance with the program. Because of this and, for example, because of the upward bulge of the ends of the blanks, the unstacking of double blanks can be significantly reduced. The vibration is well below hearing range, so that there is no additional noise disturbance. After the vibration phase, the conveying carrier 18 is accelerated and delayed on an optimal path curve by the adjusting drive means 29, 30 by way of the CNC control 25. In this way, a gentle treatment of the surfaces of the blanks to be unstacked and conveyed is assured.

Adaptation to a new workpiece to be manufactured is essentially possible by changing the program with the aid of the cassette storage input 48.

The adjusting drive means 31, indicated in dashed lines, is not absolutely necessary, but can be used, for instance, for adjusting the support frame 13 with respect to the press 10 or for the traveling motion of the exchangeable pushcarts 14, 15.

In many cases it can be expedient to construct one or more of the adjusting drive means 29, 30, 31 with the aid of linear motors, wherein, for example, the conveying carrier 18 is moved in position into the end areas of the support frame 13, and is moved without any control in the relatively large intermediate area.

It is to be understood that the above-described arrangements are simply illustrative of the application of the principles of this invention. Numerous other arrangements may be readily devised by those skilled in the art which embodies principles of the invention and falls within its spirit and scope.

We claim:

1. A loading device for loading blanks from a stack into a tool chamber of a press having a main press drive, comprising:

a guide frame located adjacent the press and extending over the stack of blanks;

a carrier mounted on said guide frame;

a support mounted on a guide element of said carrier;

a first numerically controlled drive means to move the carrier along said guide frame in a first direction;

a second numerically controlled drive means to move the support in the guide element in a second direction perpendicular to the first direction;

gripper elements, wherein said gripper elements can be moved laterally outside of an area under said carrier frame into the tool chamber of the press to lift workpieces from the stack and deliver them into said press working area;

a plurality of adjustable drive means controlled by a numerical control unit which is independent of the press drive means, said adjustable drive means being coupled to the gripper elements to move the gripper elements in either of said first and second directions to remove blanks from the stack and carry them along a preselected path outside of the area under the carrier frame and into the tool chamber; and means for checking for double blanks being lifted from the stack by the gripper elements.

2. A loading device according to claim 1, further comprising a double blank depot located between the stack and the press along the path of the gripper elements to receive any double blanks detected by said checking means.

3. A loading device according to claim 1, further comprising a third numerically controlled drive means to move the guide frame in a third direction perpendicular to the first and second directions.

4. A loading device according to claims 1, 2, or 3, wherein said gripper elements are vacuum operated.

5. A loading device according to claim 3, further comprising a guide rail mounted on the side of the press, wherein one end of the guide frame is inserted in said guide rail for movement in the third direction along the side of the press.

6. A loading device according to claim 5, further comprising an additional guide rail located alongside the stack, wherein the other end of the guide frame is inserted in said additional guide rail.

7. A loading device according to claim 1, wherein the numerical control unit further comprises a plurality of positioning control circuits coupled to the drive means for providing desired drive signals to said drive means.

8. A loading device according to claim 7, further including means coupled between the drive means and the positioning control circuits for indicating the actual drive signals, and comparison means for receiving and comparing the desired drive signals from said positioning control circuit and the actual drive signals from said indicating means, wherein said comparison means generate resultant signals based on said comparisons to control said drive means.

9. A loading device according to claim 1, further comprising:

valves coupled between the numerical control unit and the gripper elements to control the actuation of the gripper elements in accordance with commands from the numerical control unit.

10. A loading device according to claim 1, further comprising adaptation and control means coupled to the numerical control unit for coupling press operation control signals to the numerical control unit so that said numerical control unit can control the loading operation based on the states of press operation.

11. A loading device for loading blanks from a stack into a tool chamber of a press having a main press drive, comprising:

gripper elements;

a plurality of adjustable drive means controlled by a numerical control unit which is independent of the press drive means, said adjustable drive means being coupled to the gripper elements to move the gripper elements in either of two planes which are perpendicular to each other to remove blanks from the stack and carry them along a preselected path into the tool chamber; and means for checking for double blanks being lifted from the stack by the gripper elements, and further comprising said numerical control unit controlling said adjustable drive means to superimpose a low-frequency vibration with a fading magnitude on the gripper elements while the gripper elements are removing blanks from the stack to reduce the unstacking of double blanks.

12. A loading device for loading blanks from a stack into a tool chamber of a press having a main press drive, comprising:

gripper elements;

a plurality of adjustable drive means controlled by a numerical control unit which is independent of the press drive means, said adjustable drive means being coupled to the gripper elements to move the gripper elements in either of two planes which are perpendicular to each other to remove blanks from the stack and carry them along a preselected path into the tool chamber; and means for checking for double blanks being lifted from the stack by the gripper elements, wherein the stack is located on a pallet placed on an exchangeable pushcart which is movable along a path which is at right angles to the path of the gripper elements, wherein the pushcart is movable between first and second end positions along said pushcart path.

13. A loading device according to claim 12, further comprising a second exchangeable pushcart arranged in tandem with the first pushcart for motion along a second pushcart path parallel to the first pushcart path.

* * * * *